United States Patent [19]

Florin

[11] Patent Number: 4,817,530

[45] Date of Patent: Apr. 4, 1989

[54] DELAY DETONATOR

[75] Inventor: Hans Florin, Troisdorf Sieglar, Fed. Rep. of Germany

[73] Assignee: Dynamit Nobel Aktiengesellschaft, Troisdorf, Fed. Rep. of Germany

[21] Appl. No.: 921,202

[22] Filed: Oct. 21, 1986

[30] Foreign Application Priority Data

Apr. 26, 1986 [DE] Fed. Rep. of Germany ..... 3614301
Aug. 29, 1986 [DE] Fed. Rep. of Germany ..... 3629371

[51] Int. Cl.[4] ..... F42B 3/16
[52] U.S. Cl. ..... 102/322; 102/204
[58] Field of Search ..... 102/322, 200, 204, 205, 102/275.2, 275.3, 275.7, 275.9, 275.11, 275.12

[56] References Cited

U.S. PATENT DOCUMENTS

| | | | |
|---|---|---|---|
| 2,823,609 | 2/1958 | Johnson et al. | 102/275.3 |
| 2,857,845 | 10/1958 | Seavey | 102/204 |
| 3,306,201 | 2/1967 | Noddin | 102/275.3 |
| 3,353,485 | 11/1967 | Miller et al. | 102/275.3 |
| 3,460,477 | 8/1969 | Heidemann et al. | 102/275.2 |
| 3,690,260 | 9/1972 | Prior | 102/205 |
| 3,724,383 | 4/1973 | Gallaghan et al. | 102/275.9 |
| 3,728,965 | 4/1973 | Silvia | 102/204 |
| 4,335,652 | 6/1982 | Bryan | 102/275.3 |
| 4,527,481 | 7/1985 | Evans et al. | 102/204 |
| 4,660,472 | 4/1987 | Stevens | 102/275.5 |

FOREIGN PATENT DOCUMENTS 749682 1/1967 Canada .

*Primary Examiner*—Deborah L. Kyle
*Assistant Examiner*—Michael J. Carone
*Attorney, Agent, or Firm*—Antonelli, Terry & Wands

[57] ABSTRACT

A nonelectric delay detonator has, in a casing, a secondary charge as well as a delay device. The delay detonator is initiated by an ignition transfer hose extending into the casing. A partition is arranged between a hose end and the delay device. Ignition of the delay device is effected by the hose by impact or heat. An auxiliary charge (e.g. a primer cap) is located on the other side of the partition, this auxiliary charge ignites a delay charge of the delay device. In this way, the delay device burns in a closed system from which gas and pressure cannot escape into the hose. Thereby the scattering width of the delay times of the detonator is reduced.

19 Claims, 4 Drawing Sheets

DELAY DETONATOR

This invention relates to a delay detonator, especially a nonelectric delay detonator, having a casing containing a secondary charge and a delay means, and an ignition transfer hose operatively connected to the casing; the casing also including means for sealing off the delay means from the hose to insure small variations in the delay times of the detonator.

Delay detonators serve for causing explosion of various charges in a specific sequence in rock blasting or in mining operations. Each delay detonator contains a delay means for delaying ignition of the charge by an exactly defined delay period. Electrical delay detonators are initiated by the electric ignition of a fusehead. An electrical delay detonator constitutes a "closed system" wherein all pyrotechnical components are surrounded sealingly by a metallic sleeve.

Nonelectric delay detonators are furthermore known which are connected to an ignition transfer hose. Threads of a reactive material extend within the hose. By igniting these threads at one hose end, a self-sustaining ignition flame is produced in the hose, together with a shock wave whereby flammable materials can be ignited at the other end of the hose. The hose transmits the ignition flame to the delay detonator and effects first of all the deflagration of a pyrotechnical delay charge which determines the individual delay time of the delay detonator. Since the hose projects into the casing of the delay detonator, the delay detonator constitutes an "open system". Such an open system has the drawback that the pressure being built up in the casing can be released, in part in an undefinable fashion, through the hose so that the desire defined delay period cannot be attained. Therefore, delay detonators according to the open system exhibit considerable scattering width for the delay times.

The invention is based on the object of providing a nonelectric delay detonator wherein the delay means burns in a closed system so that a small scattering width (i.e. variations) of the delay times is achieved.

This object has been attained according to this invention by providing means for sealing off of the delay means from the ignition transfer hose.

In the delay detonator of this invention, the space of the casing containing the delay means and the secondary charge (i.e. base charge) is separated in a pressure-proof fashion by a partition from the ignition transfer hose, and this separation is maintained even during deflagration of the delay means. Ignition transfer from the hose to the delay means takes place by the effect of an impact or by thermal energy transfer through the partition. While conventional nonelectric delay detonators form an open system wherein release of pressure and gas takes place, during deflagration of the delay means, through the hollow hose, the invention provides a sealing partition, by which a closed system is created. As a consequence, the delay means burns up under defined pressure conditions so that reproducible delay times with small scattering widths are achieved.

Another advantage of the present invention resides in that it is possible by means of the delay detonator according to this invention, using the same delay devices or means, to obtain the same average delay time values as in case of electric delay detonators with a closed system. The position of the average delay time value depends, in this context, on the strength of the auxiliary charge and on the volume between the auxiliary charge and the delay means. Another advantage resides in that the delay times are independent of the initial output of the ignition transfer hose and thus of any possible scattering displayed by individual hoses.

Transfer of ignition from the ignition transfer hose to the delay means can take place either by means of a percussion-initiatable primer cap through impact transmission through the partition, or by means of a thermally sensitive charge by heat transfer through the partition.

Advantageous embodiments and further developments of the invention will be recognized from the following detailed description and appended claims.

Embodiments of the invention are described in greater detail with reference to the accompanying drawings wherein.

Figure 1:
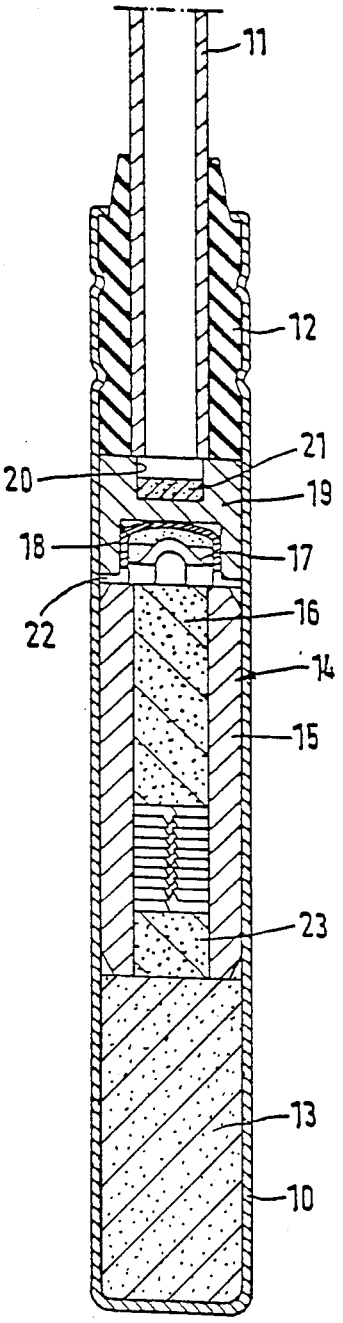
FIG. 1 shows a longitudinal section through a first embodiment of the delay detonator, with a primer cap accommodated in a partition.

The delay detonator according to FIG. 1 has a cylindrical casing 10 made of metal (e.g. aluminum or copper), or like material, closed at the lower end, and an ignition transfer hose 11 extending into the upper end of the casing. The ignition transfer hose consists of a plastic tube (e.g. polyethylene), threads of a reactive material (e.g. nitrocellulose) being disposed in the hollow space thereof in such a way that there extends through the hose, by chemical reaction of the threads, a self-sustaining ignition flame accompanied by a shock wave with which flammable substances can be ignited at the exit end of the hose. One such hose is being sold under the designation of "Signal-Tube" by ATLAS Powder Company. The end of the hose projecting into the casing 10 is surrounded by a sealing plug 12 of an elastomeric material fixed by crimping in the upper zone of the casing. The sealing plug 12 terminates, in the interior of the casing 10, flush with the hose end.

A secondary charge 13 (i.e. base charge e.g. tetryl or PETN) is arranged in the lower region of the casing 10, and a delay means or device 14 consisting of a tube 15 which contains a delay charge 16 is arranged above the secondary charge.

An auxiliary charge, in the form of a primer cap 17, rests on the upper end of the delay means 14. The primer cap projects into a recess 18 in the underside of a partition 19, the partition being arranged in direct contact with the sealing plug 12 and, respectively, the end of the hose 11. A further recess 20 in the top side of the partition 19 houses a booster charge 21 which can be ignited by an ignition flame exiting from the end of the hose 11.

In the embodiment of FIG. 1, an axial spacing 22 exists between the partition 19 and the delay means 14; in other words, the primer cap 17 projects downwardly past the recess 18. The partition 19, sealing the lower cavity of the casing 10 with respect to the hose 11, consists of a rigid material (e.g. aluminum) which is not substantially deformed upon detonation of the booster charge 21.

The delay detonator according to FIG. 1 operates as follows:

The reaction of the reactive threads continuing through the hose 11 produces, at the outlet from the hose in the interior of the casing 10, an ignition flame igniting the booster charge 21. This booster charge 21, consisting, for example of an initiating explosive such as lead azide or lead styphnate, or of a mixture of initiating explosives, effects by a shock-like reaction a shifting of the partition 19 in the direction toward the delay means 14 whereby the primer cap 17 is ignited. During this process, the sealing action of the partition 19 remains preserved. By ignition of the primer cap 17, the delay charge 16 is ignited and the delay charge in turn ignites, after the intended deflagration period, the initiating charge 23 (e.g. lead azide) arranged at its end; the initiating charge 23 ignites the secondary charge 13. Due to the fact that the delay means 14 burns in a closed space, the nonelectric delay detonator of this invention achieves the same accurate delay periods, with very small delay time scattering widths, as in case of closed, electric delay detonators. These periods are illustrated by the following Table I wherein measured delay periods, their average values and scattering widths are shown.

Delay Periods, Their Average Values and Scattering Widths

| Conventional Nonelectric Delay Detonators | Nonelectric Delay Detonators According to Invention with Ignition Transfer Element | Electric Delay Detonators |
|---|---|---|
| Average Value: 311 ms Scattering Width: 10.5 ms (Standard Deviation) | Average Value: 292 ms Scattering Width: 4.6 ms (Standard Deviation) | Average Value: 294 ms Scattering Width: 4.5 ms (Standard Deviation) |

All of the detonators measured, the results of which are listed in Table I, were equipped with the same delay devices of a manufactured batch which resulted, in the sealed electric delay detonator, in an average delay time of 294 ms.

The embodiments of FIGS. 2 through 5 correspond basically to that of FIG. 1 so that the respective descriptions of the additional embodiments are described with reference to the differences with respect to the embodiment of FIG. 1.

Figure 2:
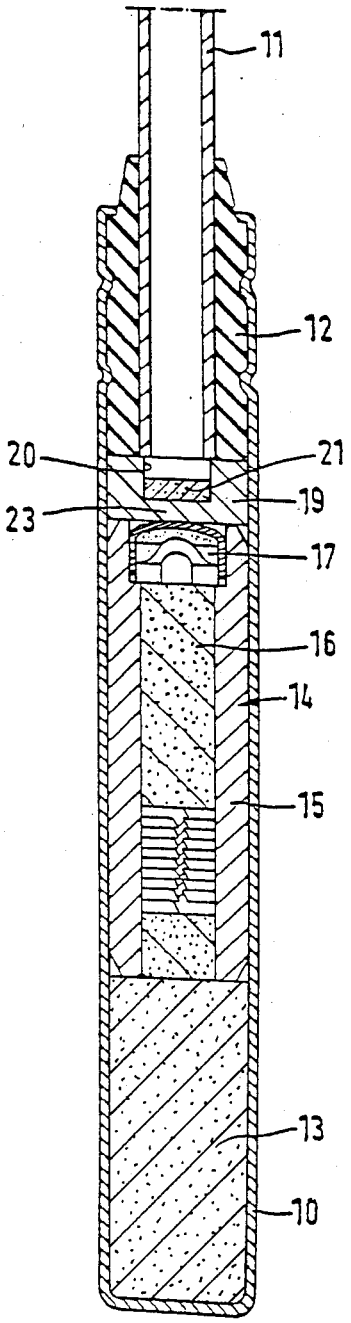
FIG. 2 shows a second embodiment with the primer cap being housed in a delay means.

According to FIG. 2, the primer cap 17 containing the auxiliary charge is accommodated in a recess of the delay means 14, and the partition 19 fills out the space between the delay means 14 and the sealing plug 12 entirely in the axial direction. The bottom of the upper recess 20 of partition 19 in this embodiment constitutes a deformation zone 23 which bulges downwardly upon detonation of the booster charge 21, but does not open up. The deformation zone 23, upon detonation of the booster charge 21, impacts against the primer cap 17 resting on the tube 15, the primer cap being thereupon ignited and igniting the delay charge 16.

Figure 3:
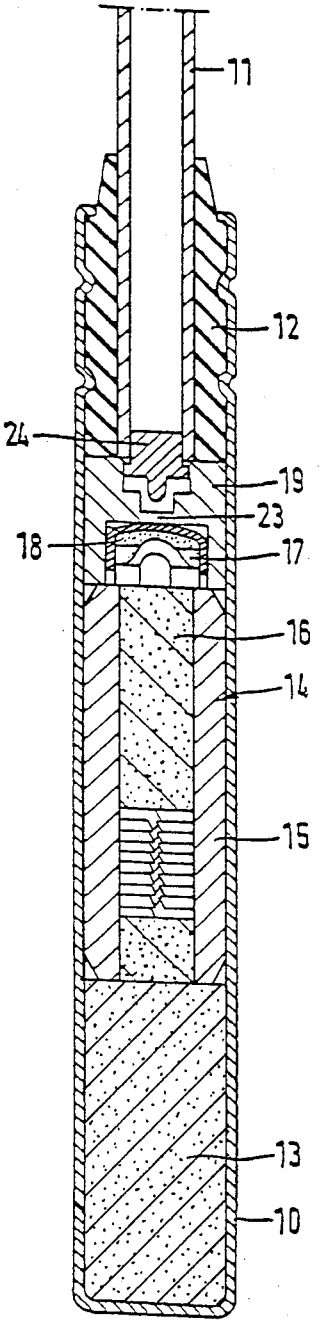
FIG. 3 shows a third embodiment with a striker pin hitting the partition.

In the embodiment of FIG. 3, the primer cap 17, as in FIG. 1, is housed in a lower recess 18 of the partition 19. The primer cap 17 rests on the delay means 14 and urges the partition 19 against the sealing plug 12. A striker pin 24 is guided in the end of the hose 11; this striker pin is accelerated in the downward direction by the gas pressure generated in the hose 11 and strikes with its tip, which is spherical for example, against the partition 19, thereby igniting the primer cap 17. The partition 19 and the striker pin 24 are of such a structure that the striker pin 24 is moved only along a limited path length. This path length is dimensioned so that the partition 19 is not penetrated. In the embodiment of FIG. 3, the deformation zone 23 of the partition 19 is deformed by the impact of the striker pin 24 in the direction toward the delay means 14.

Figure 4:
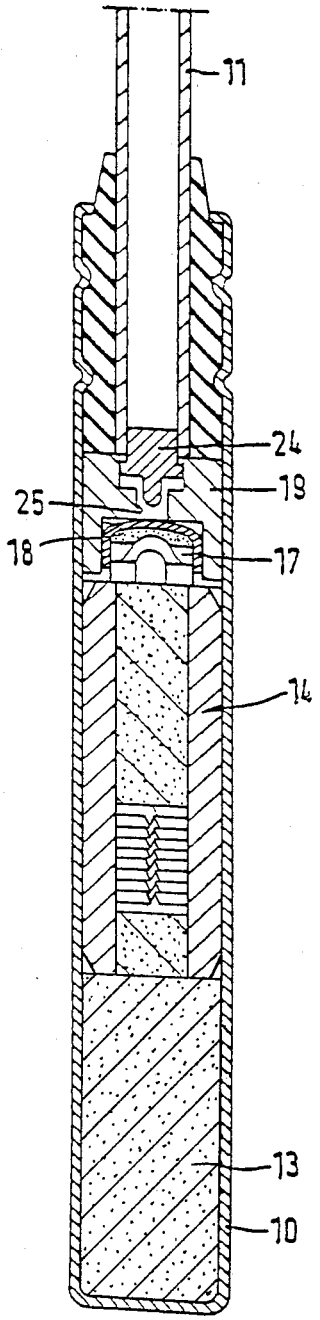
FIG. 4 shows a fourth embodiment with a striker pin directly hitting the primer cap of the detonator.

The embodiment of FIG. 4 corresponds to that of FIG. 3, except for the fact that, according to FIG. 4, the partition 19 exhibits an aperture 25 through which the striker pin 24 impinges directly on the primer cap 17. The path traversed by the striker pin 24 and the primer cap 17 are adapted to each other so that the primer cap remains closed when struck by the striker pin. The primer cap is inserted in the recess 18 by cementing or by fitting so that it seals tightly the lower portion of the partition 19. This tight seal remains intact even after ignition of the primer cap 17.

Figure 5:
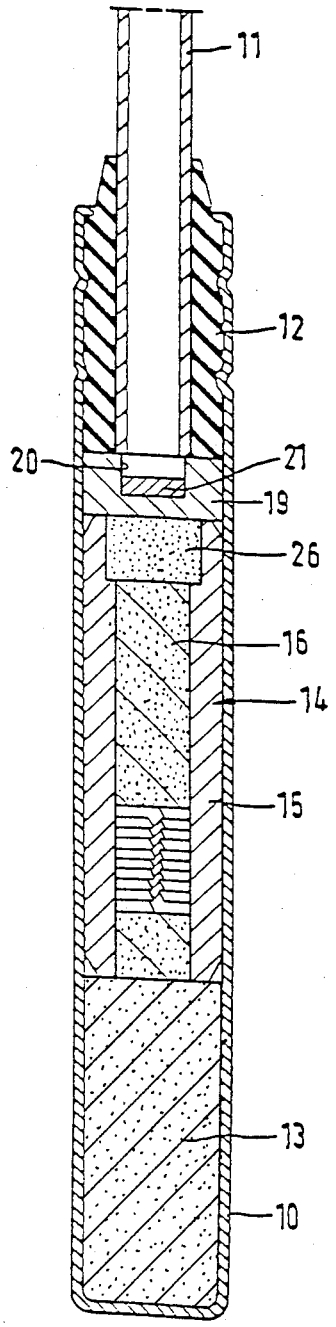
FIG. 5 shows a further embodiment with thermal transfer through the partition.

The embodiment of FIG. 5 corresponds to that of FIG. 2, except for the fact that a thermally sensitive charge 26 is provided in place of the primer cap 17, this charge being in thermal contact with the partition 19. The partition 1 is not substantially deformed during the deflagration of the booster charge 21, but rather is merely heated, and the heat is transferred to the charge 26 by heat conductance through the partition. The charge 26 is thereby ignited and, in turn, ignites the delay charge 16. The partition 19 in this embodiment thus consists of a material of high heat conductivity.

In those embodiments utilizing a booster charge 21, this charge can be covered with a thin foil, for example of aluminum, for protection against environmental pollution, moisture, and to avoid leakage of the charge; this foil is punctured by the ignition jet of the hose 11.

Such a foil covering the booster charge 21 is of decisive importance for the electrostatic safety of the detonator (i.e. ignition inertness with respect to electrostatic discharges).

Figure 6:
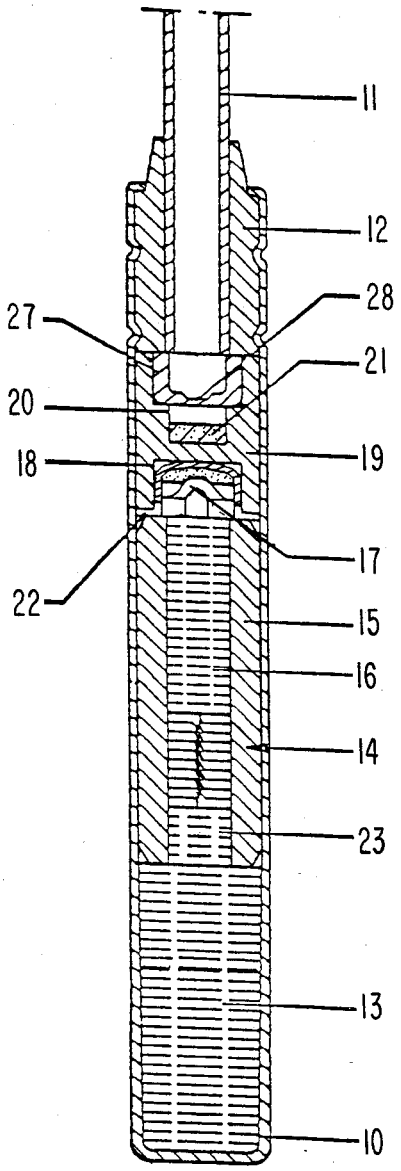
FIG. 6 shows an embodiment wherein a metallic sleeve is provided to shield the booster charge.

In case of an electric spark discharge from the ignition transfer hose into the interior of the detonator, a spark discharge into the booster charge 21 must be avoided at all costs. By covering the booster charge with a metallic foil connected electrically conductively with the partition 19, the booster charge is shielded, as in a Faraday cage, so that spark discharge from the ignition transfer hose onto or into the partition cannot lead to ignition of the booster charge. The booster charge can also be covered by a metallic sleeve 27 (e.g. aluminum) with a very thin bottom 28, as in the embodiment of FIG. 6. The bottom of sleeve 27 is so thin that it is penetrated by the ignition jet of the ignition transfer hose.

Figure 7:
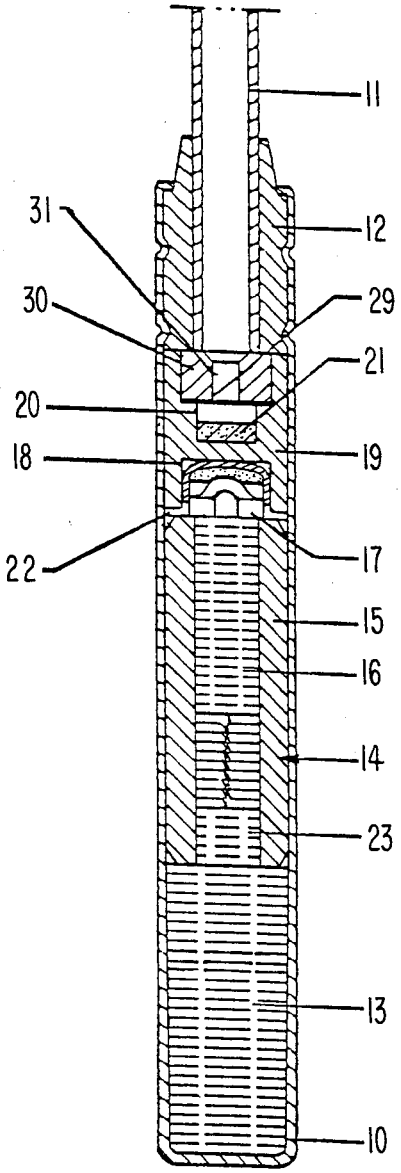
FIG. 7 shows another embodiment for shielding the booster 10 charge with a nonmetallic film.

Furthermore, the booster charge 21 can be covered by means of a nonmetallic film 29 (for example a paper film). Such a film, which is not electrically conductive, must be held by an electrically conductive mounting member 30 (for example made of aluminum), as in the embodiment of FIG. 7, in such a way that the ignition transfer hose cannot rest on the film. The bore 31 of the mounting member 30 that allows the ignition jet to pass through should be smaller than the recess 20 containing the booster charge 21. This ensures that an electrical spark discharge from the ignition transfer hose will in all cases take place onto the mounting member 30 and never through the cover film into the booster charge 21.

In those cases wherein the partition is rigid and acts by impact transmission on the primer cap 17, the partition should consist of a hard material well capable of conducting a shock wave, for example of a hard plastic, glass, or ceramic material (e.g. $Al_2O_3$-ceramic). If the partition 19 has a deformation zone, the partition should consist of a metal or a synthetic resin (e.g. polyvinyl chloride).

There is also the possibility of using a diaphragm-like partition which is so thin that it is deformed by the pressure wave progressing within the hose in such a way that the primer cap is ignited by such deformation.

What is claimed is:

1. A delay detonator comprising a casing containing, in sequence, a secondary charge, a delay means for establishing the delay time period of said detonator, a sealing partition, a booster charge, and an ignition transfer hose extending into one end of the casing, the reaction of reactive material within said ignition transfer hose progressing within the ignition transfer hose to cause reaction of the booster charge which acts via said partition to activate said delay means; the delay means, in turn, causing, after a predetermined delay period, detonation of the secondary charge within said casing; the sealing partition being arranged within the casing between the one end of the ignition transfer hose and the delay means and an auxiliary charge being arranged on that side of the partition facing the delay means, said auxiliary charge being ignitable by energy generated by reaction of said booster charge, while a sealing action is maintained by said partition during ignition of the delay means; and said partition having on a side facing the one end of the hose a recess wherein the booster charge is arranged.

2. A delay detonator according to claim 1, wherein the partition comprises a solid plate which is not perforated and which contacts said auxiliary charge.

3. A delay detonator according to claim 2, wherein the auxiliary charge consists of a thermally sensitive charge arranged behind the partition and ignited through the partition by the transfer of heat generated by the reaction of said booster charge.

4. A delay detonator according to claim 2, wherein the partition is made of glass.

5. A delay detonator according to claim 2 wherein the partition is made of a ceramic material.

6. A delay detonator according to claim 1, wherein the partition has on a side facing the the delay means a recess wherein the auxiliary charge is arranged.

7. A delay detonator according to claim 6, wherein the auxiliary charge consists of a thermally sensitive charge arranged behind the partition and ignited through the partition by the transfer of heat generated by the reaction of said booster charge.

8. A delay detonator according to claim 6, wherein the partition is made of metal.

9. A delay detonator according to claim 6, wherein the partition is made of a synthetic resin.

10. A delay detonator according to claim 1, wherein the partition is made of metal.

11. A delay detonator according to claim 1, wherein the partition is made of a synthetic resin.

12. A delay detonator according to claim 1, wherein said auxiliary charge is ignitable by impact of a portion of the partition which is deformed by the reaction of said booster charge.

13. A delay detonator according to claim 1, wherein said auxiliary charge is ignitable by heat transmitted through a portion of said partition which heat is generated by reaction of said booster charge.

14. A delay detonator according to claim 1, wherein the partition has a deformation zone, and the auxiliary charge comprises a primer cap supported by the delay means, said delay means comprising a tube containing a delay charge, the deformation zone acting on said primer cap when activated by the progressing reaction of said ignition transfer hose and reaction of said booster charge.

15. A delay detonator according to claim 1, wherein the partition has a recess in which the auxiliary charge is arranged and a deformation zone located between the recess in which a booster charge is arranged and the recess in which the auxiliary charge is arranged, said deformation zone comprising a solid non-perforated portion of the partition, and the deformation zone acting upon said auxiliary charge when activated by the progressing reaction of said ignition transfer hose and reaction of said booster charge.

16. A delay detonator comprising a casing containing, in sequence, a secondary charge, a delay means for establishing the delay period of said detonator, a sealing partition, a booster charge, and an ignition transfer hose extending into one end of the casing, the reaction of reactive material within said ignition transfer hose progressing within the ignition transfer hose and acting, upon reaching one end of the hose, to cause reaction of the booster charge which acts via said partition to activate said delay means; the delay means causing, after a predetermined delay period, detonation of the secondary charge within said casing; the sealing partition being arranged within the casing between the one end of the hose and the delay means and an auxiliary charge being arranged on that side of the partition facing the delay means, said delay charge being ignitable by energy generated by reaction of said booster charge while a sealing action is maintained by said partition during ignition of the delay means; the partition having a deformation zone, and the auxiliary charge comprising a primer cap resting on a delay charge of the delay means, the deformation zone acting on said primer cap when activated by the progressing reaction of said ignition transfer hose and reaction of said booster charge.

17. A delay detonator comprising a casing containing, in sequence, a secondary charge, a delay means for establishing the delay period of said detonator, a sealing partition, a booster charge, and an ignition transfer hose extending into one end of the casing, the reaction of reactive material within said ignition transfer hose progressing within the ignition transfer hose and acting, upon reaching one end of the hose, to cause reaction of the booster charge which acts via said partition to activate said delay means; the delay means causing, after a predetermined delay period, detonation of the secondary charge within said casing; the sealing partition being arranged within the casing between the one end of the ignition transfer hose and the delay means and an auxiliary charge being arranged on that side of the partition facing the delay means, said auxiliary charge being ignitable by energy generated by reaction of said booster charge while a sealing action is maintained by said partition during ignition of the delay means; said partition having on a side facing the one end of the ignition transfer hose a recess wherein the booster charge is arranged, said partition being made of metal and the booster charge in the metal sealing partition being covered by an electrically conductive foil so that the foil is electrically conductively connected to the partition and the casing.

18. A delay detonator comprising a casing containing, in sequence, a secondary charge, a delay means for establishing the delay period of said detonator, a sealing partition, a booster charge, and an ignition transfer hose extending into one end of the casing, the reaction of reactive material within said ignition transfer hose progressing within the ignition transfer hose and acting, upon reaching one end of the hose, to cause reaction of the booster charge which acts via said partition to activate said delay means; the delay means causing, after a predetermined delay period, detonation of the secondary charge within said casing; the sealing partition being arranged within the casing between the one end of the ignition transfer hose and the delay means and an auxiliary charge being arranged on that side of the partition facing the delay means, said auxiliary charge being ignitable by energy generated by reaction of said booster charge while a sealing action is maintained by said partition during ignition of the delay means on a side facing the one end of the ignition transfer hose and partition having a recess wherein the booster charge is arranged said partition being made of metal and the booster charge in the metal sealing partition being covered by an electrically nonconductive film; and a mounting member made of an electrically conductive material, said mounting member having a bore which is smaller than the recess in the partition.

19. A delay detonator comprising a casing having a closed end, said casing containing, in sequence, a secondary charge, a delay means for establishing the delay time period of said detonator, a sealing partition, a booster charge, and an ignition transfer hose extending into an opening at one end of the casing, the reaction of reactive material within said ignition transfer hose progressing within the ignition transfer hose and acting, upon reaching one end of the hose to cause reaction of the booster charge which acts via said partition to activate said delay means; the delay means causing, after a predetermined delay period, detonation of the secondary charge within said casing; the sealing partition being arranged within the casing between the one end of the ignition transfer hose and the delay means and an auxiliary charge being arranged on that side of the partition facing the delay means, said auxiliary charge being ignitable by energy generated by reaction of said booster charge, while a sealing action is maintained by said partition during ignition of the delay means; said partition having one portion defining a recess in which the booster charge is arranged, another portion defining a recess in which the auxiliary charge is arranged and a plate-like portion, one side of which contacts the booster charge and the other side of which contacts the auxiliary charge, said plate-like portion providing a zone acting to transmit said energy to said auxiliary charge when activated by the progressive reaction of said ignition transfer hose and the reaction of said booster charge.

* * * * *